US007069710B2

(12) United States Patent
Kwan et al.

(10) Patent No.: US 7,069,710 B2
(45) Date of Patent: Jul. 4, 2006

(54) SADDLE PAD

(76) Inventors: Yany Kwan, Rua dos Pescadores, No. 82-86, 3 andar "G", Edificio Industrial Nam Fung, Macau (MO); Billie Fong, Rua dos Pescadores, No. 82-86, 3 anda "G", Edificio Industrial Nam Fung, Macau (MO)

( * ) Notice: Subject to any disclaimer, the term of this patent is extended or adjusted under 35 U.S.C. 154(b) by 4 days.

(21) Appl. No.: 10/929,201

(22) Filed: Aug. 30, 2004

(65) Prior Publication Data

US 2005/0060968 A1 Mar. 24, 2005

Related U.S. Application Data

(60) Provisional application No. 60/498,770, filed on Aug. 30, 2003.

(51) Int. Cl.
*B68C 1/12* (2006.01)

(52) U.S. Cl. ..... 54/66

(58) Field of Classification Search ..... 54/44.1, 54/65, 66
See application file for complete search history.

(56) References Cited

U.S. PATENT DOCUMENTS

| | | | | |
|---|---|---|---|---|
| 86,798 | A * | 2/1869 | Allison | 54/66 |
| 87,379 | A * | 3/1869 | Sturges | 54/66 |
| 1,006,960 | A * | 10/1911 | Leibe | 54/66 |
| 5,802,823 | A * | 9/1998 | Woods | 54/66 |

* cited by examiner

*Primary Examiner*—Robert P. Swiatek

(57) ABSTRACT

A saddle pad having a malleable zone that permits a relief area to be shaped between the saddle pad and the withers of the horse. The malleable zone is generally formed near the apex of the leading edge of the saddle pad and may include one or more ductile elements. The one or more ductile elements may be shaped or otherwise bent to the optimal shape for each individual animal and each individual saddle to provide a relief area. The malleable zone may also include EVA foam as surface or embedded padding, and nylon webbing may be used on the surface or embedded to reduce the discomfort to the horse due to the weight of a saddle and rider or movement of the saddle during riding. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

6 Claims, 5 Drawing Sheets

SADDLE PAD

RELATED APPLICATION

This application claims the priority of provisional patent application 60/498,770 filed Aug. 30, 2003.

BACKGROUND OF THE INVENTION

1. Field of the Invention

The present invention relates generally to the field of riding pads and more specifically to equestrian saddle pads.

2. Description of the Prior Art

A saddle pad, located between an animal and a saddle, protects the animal from irritation due to the weight of the saddle and rider or slippage of the saddle from its proper position. Similarly, some type of pad has been used between a pack and the pack animal to protect the animal from irritation due to the weight of the pack or slippage of the pack. Historically, blankets and other woven products and sheep skins have been used as a pad between a ridden animal and a saddle or a pack animal and a pack.

Conventional saddle blankets and saddle pads only provide partial relief from the constant rubbing and pounding a saddle and rider inflict on the withers. Horses subjected to daily training are prone to develop soreness over the withers, shoulders and back. The musculature of the horse is fairly complex and any problem in the interrelated muscle framework may result in incorrect muscle function and, or development and, or impaired performance. A problem in the withers may also affect the trapezius and result in a shortening the horse's stride. Often, the horse compensates for the impaired performance by adopting an unnatural motion. This unnatural motion stresses the entire equine body and promotes muscle shrinkage and mechanical imbalance.

What is needed is a saddle pad that provides substantial relief from the constant rubbing and pounding a saddle and rider inflict on the withers.

SUMMARY OF THE INVENTION

The present disclosure is directed to a saddle pad having a malleable zone that permits a relief area to be shaped between the saddle pad and the withers of the horse. The malleable zone is generally formed near the apex of the leading edge of the saddle pad and may include one or more ductile elements. The one or more ductile elements may be shaped or otherwise bent to the optimal shape for each individual animal and each individual saddle to provide a relief area. The malleable zone may also include EVA foam as surface or embedded padding, and nylon webbing may be used on the surface or embedded to reduce the discomfort to the horse due to the weight of a saddle and rider or movement of the saddle during riding.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION OF THE PREFERRED EMBODIMENT(S)

Figure 1:
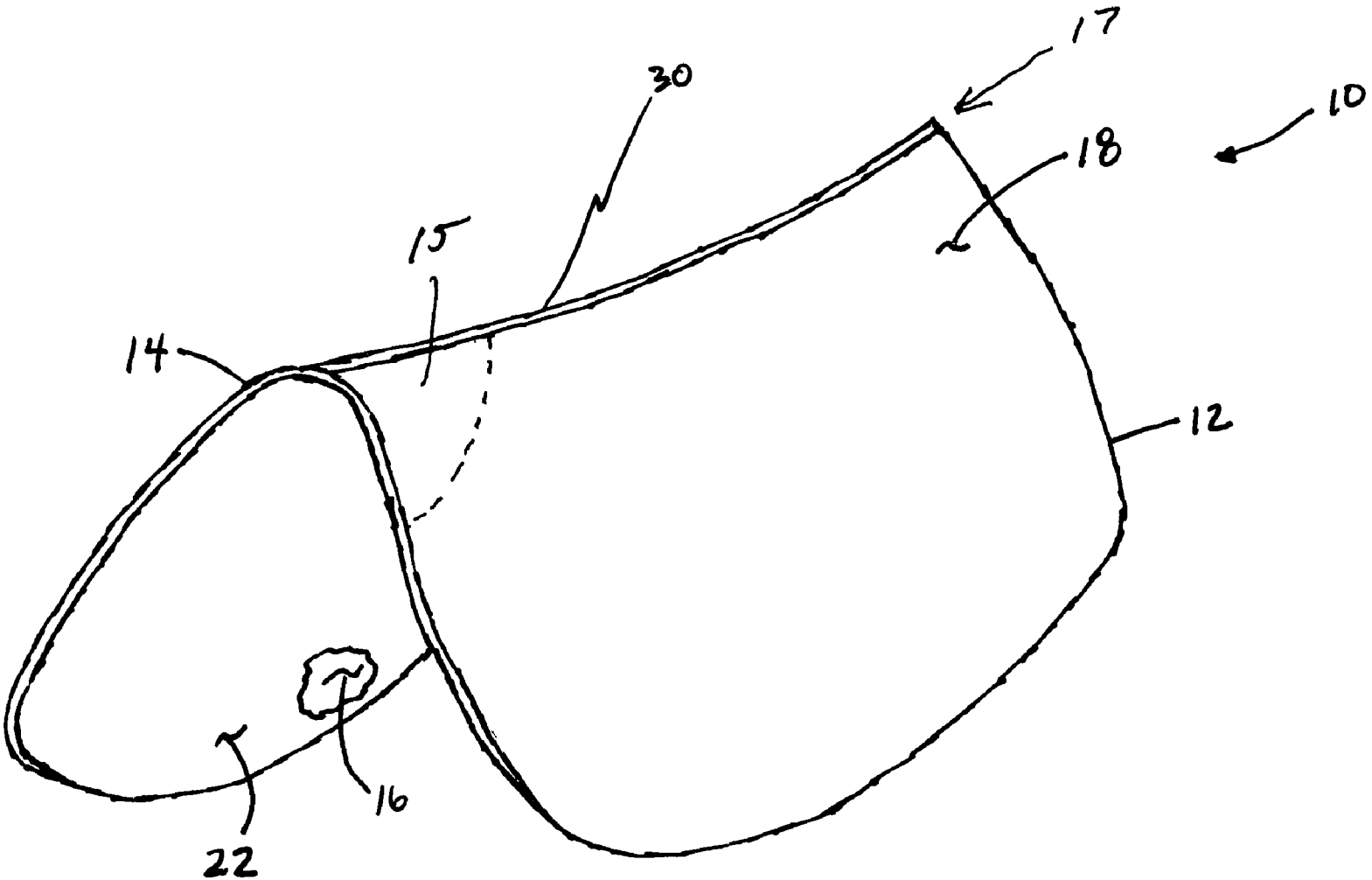
FIG. 1 is an orthogonal view of a saddle pad according to the present disclosure.

Referring now to FIG. 1, saddle pad 10 according to the present disclosure includes a main pad, shell or primary pad 12 having leading edge 14, lower edge 40, inner surface 16, outer surface 18 and malleable zone 15. The size and shape of primary pad 12 protects a horse from irritation due to the weight of a saddle and rider or movement of the saddle during riding. Primary pad 12 may be fabricated from any suitable material such as acrylic, wool, sheep skin or cotton. Saddle pad 10 having a malleable zone 15 according to the present disclosure, may provide substantial relief from the constant rubbing and pounding the saddle and rider inflict on the withers by elevating saddle pad 10 away from the withers thus avoiding constant contact with the withers while riding.

In another aspect of the present disclosure a lining material 22 may be attached to inner surface 16 of shell 12. Similarly, the lining material 22 may also be fabricated from cotton or any other suitable material.

In still another aspect of the present disclosure saddle pad 10 may include one or more web elements 30 embedded or otherwise attached to dorsal area 17 of shell 12. Web elements such as web element 30 either embedded or attached along dorsal area 17 on surface 18 may provide further protection to the withers against injury or repeated abrasion.

Figure 2:
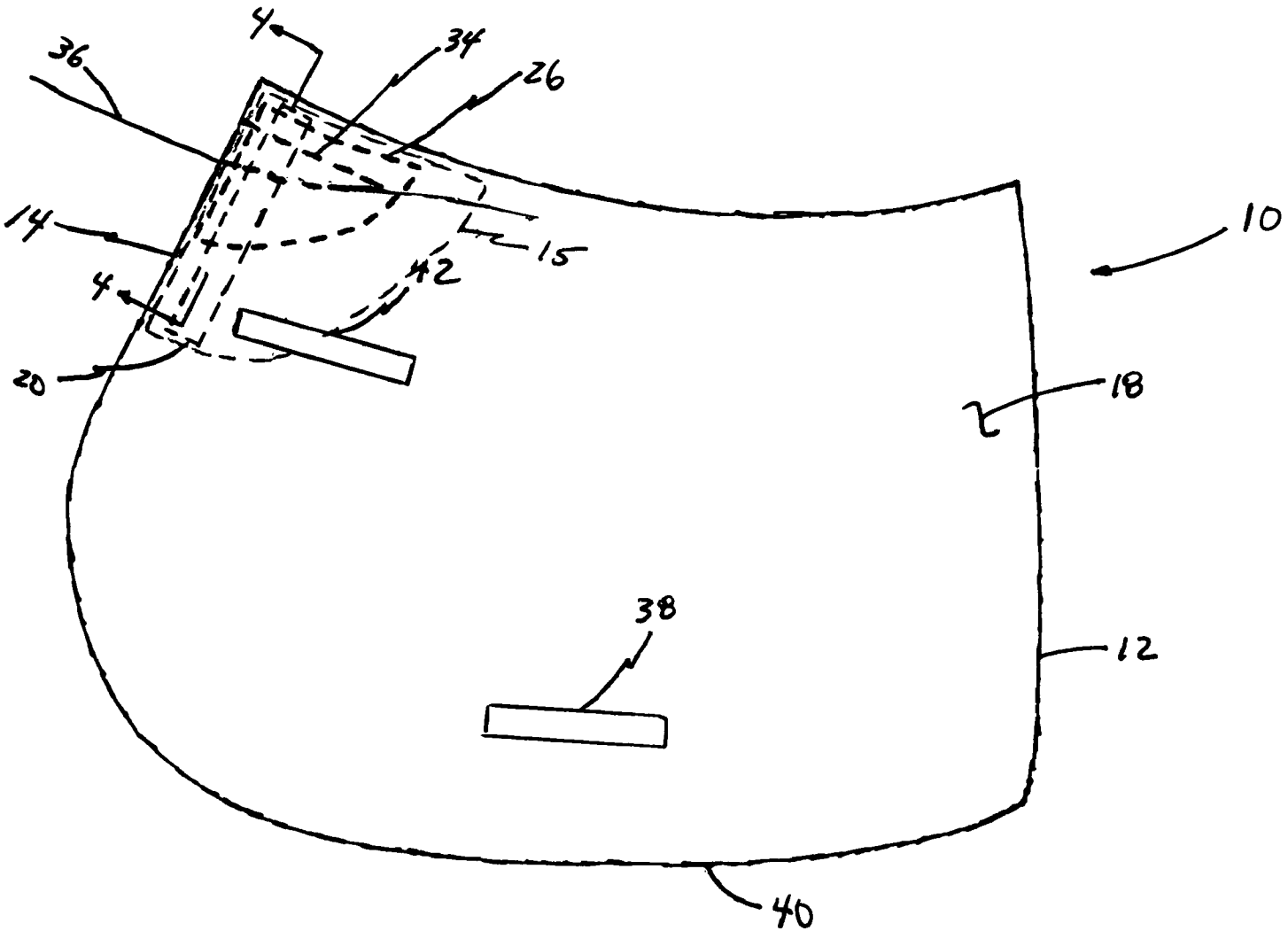
FIG. 2 is a side view of a saddle pad according to the present disclosure.

Referring now to FIG. 2, saddle pad 10 according to the present disclosure includes malleable area 15 incorporated into shell 12. Shell 12 may be fabricated from any suitable material such as acrylic, wool, sheep skin or cotton. Malleable area 15 may include a ductile element such as ductile element 20 embedded within malleable area 15 near and substantially parallel to the center of leading edge 14 of shell 12. Ductile element 20 allows the malleable area 15 to be shaped in a way that elevates saddle pad 10 away from withers 36. A rider or other user may bend ductile element 20 to a preferred shape for the saddle and withers height and width to provide a relief area 34 between pad 10 and horse withers 36. Ductile element 20 may have any suitable cross sectional shape such as round, elliptical, square or rectangular. Saddle pad 10, according to the present disclosure, may provide substantial relief from the constant rubbing and pounding the saddle and rider inflict on a horse's withers by positioning the saddle pad 10 away from the withers and introducing relief area 34.

In another aspect of the present disclosure, saddle pad 10 may include at least one secondary pad 26 embedded near the apex of leading edge 14 of shell 12 between outer surface 18 and ductile element 20. Secondary pad 26 may be flat and may afford further protection to withers 36 against injury from the saddle and ductile element 20. Secondary pad 26 may be any suitable material such as closed cell foam, EVA foam, or open cell foam, gel filled pad or an air filled pad. Pad 26 provides shock relief when relief area 34 is compressed to the point that pad 10 is in contact with the withers during riding.

In still another aspect of the present disclosure, saddle pad 10 may include at least one girth strap 38 near lower edge 40.

In yet another aspect of the present disclosure, saddle pad 10 may further include at least one billet strap 42 near leading edge 14.

Figure 3:
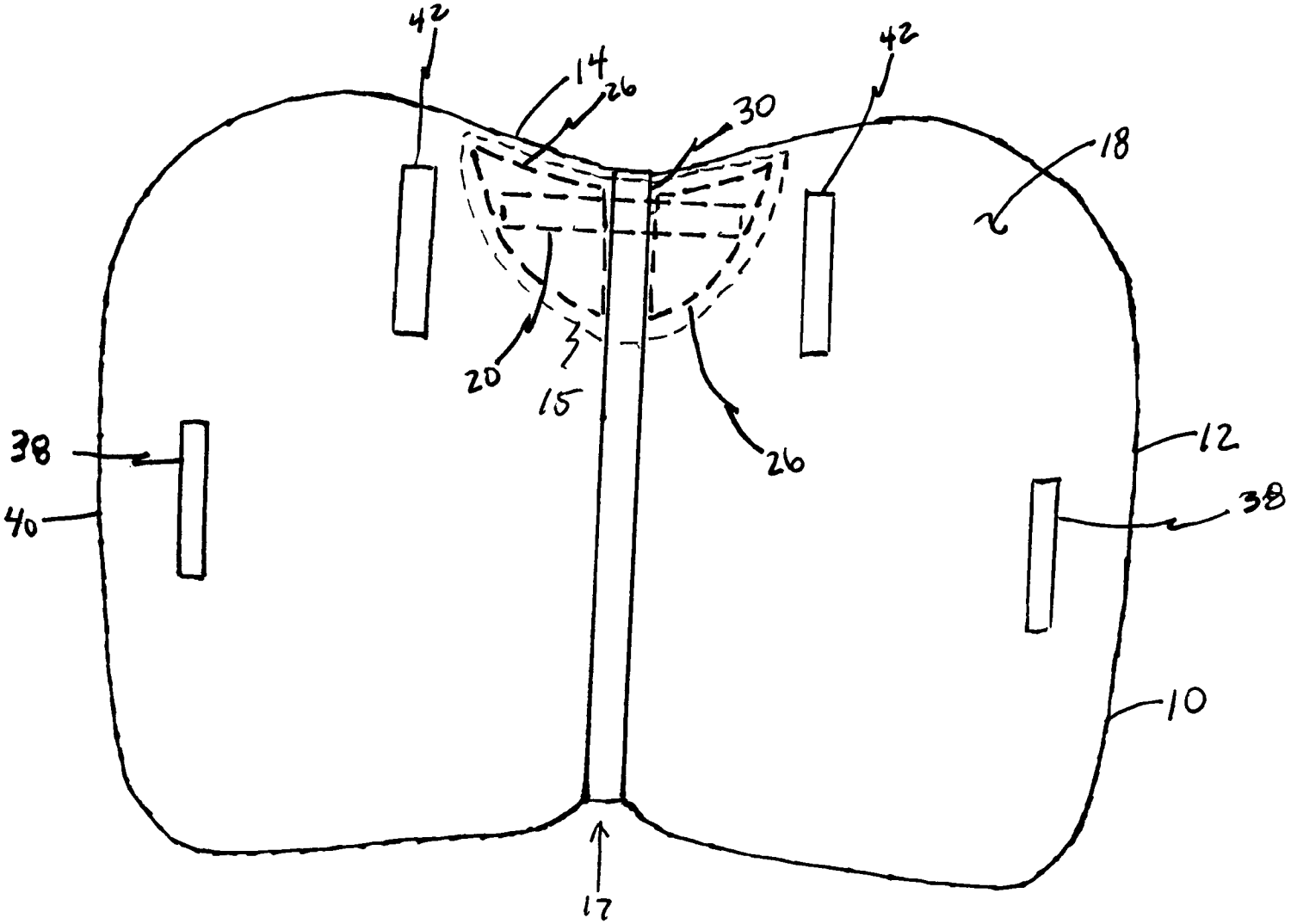
FIG. 3 a top view of a saddle pad according to the present disclosure.

Referring now to FIG. 3, saddle pad 10 according to the present disclosure may include malleable area 15 within shell 12 having leading edge 14, lower edge 40, and outer surface 18. In a currently preferred embodiment of the present disclosure malleable area 15 is generally symmetrical about apex area 17 near leading edge 14. Other suitable configurations may also be used.

Saddle pad 10 according to the present disclosure may further include web element 30 attached to outer surface 18 of shell 12 along apex 17. Web 30 may provide further protection to the withers against injury from ductile element 20.

In still another aspect of the present disclosure, saddle pad 10 may further include at least one girth strap 38 near lower edge 40.

In yet another aspect of the present disclosure, saddle pad 10 may further include at least one billet strap 42 near leading edge 14.

Figure 4:
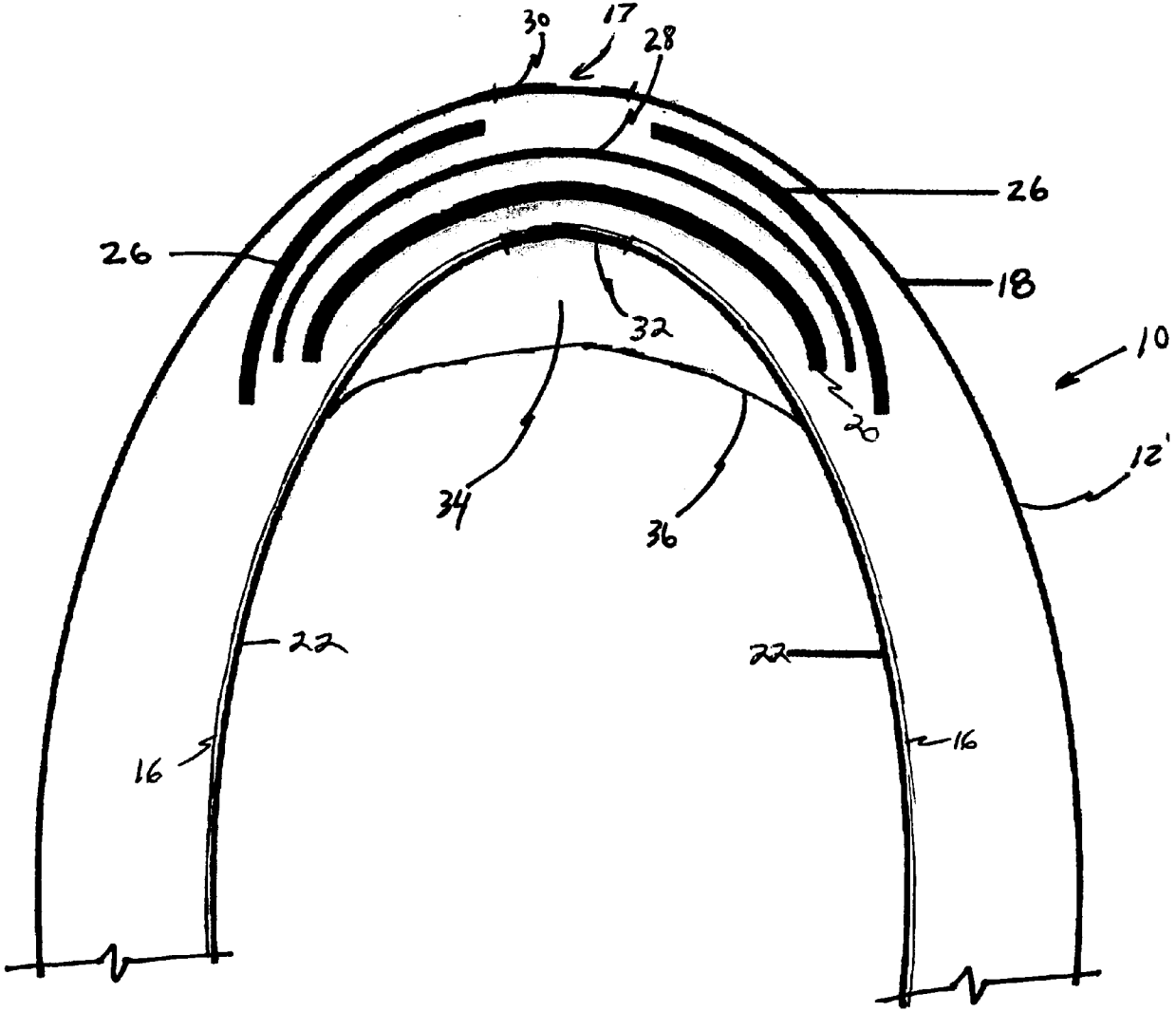
FIG. 4 is a cross sectional view of portion of the saddle pad of FIG. 2.

Referring now to FIG. 4, saddle pad 10 according to another aspect of the present disclosure may further include a liner such as liner 22 attached to inner surface 16 of shell 12. Liner 22 may be fabricated of cotton, wool, nylon or any other suitable material.

In still another aspect of the present disclosure, saddle pad 10 further includes at least one pad 26 embedded within shell 12 near the center of leading edge 14 of shell 12 between outer surface 18 and ductile element 20. Pad 26 may be flat. Pad 26 affords further protection to the withers against injury from the saddle and ductile element 20. Pad 26 may be composed of closed cell foam, EVA foam, open cell foam, gel filled pad, air filled pad, or any other suitable material. Pad 26 provides shock relief when relief area 34 is compressed to the point that pad 10 is in contact with the withers during riding.

In yet another aspect of the present disclosure, saddle pad 10 may further include a webbing layer 28 imbedded in shell 12 between pad 26 and ductile element 20. Webbing layer 28 offers further protection to the withers against injury from ductile element 20.

In still another aspect of the present disclosure, saddle pad 10 may further include attaching a webbing layer 30 to outer surface 18 of shell 12. Again, webbing layer 30 offers further protection to the withers against injury from ductile element 20.

In yet another aspect of the present disclosure, saddle pad 10 may further include attaching a webbing layer 32 to inner surface 16 of shell 12. Once again, webbing layer 32 offers further protection to the withers against injury from ductile element 20.

Figure 5:
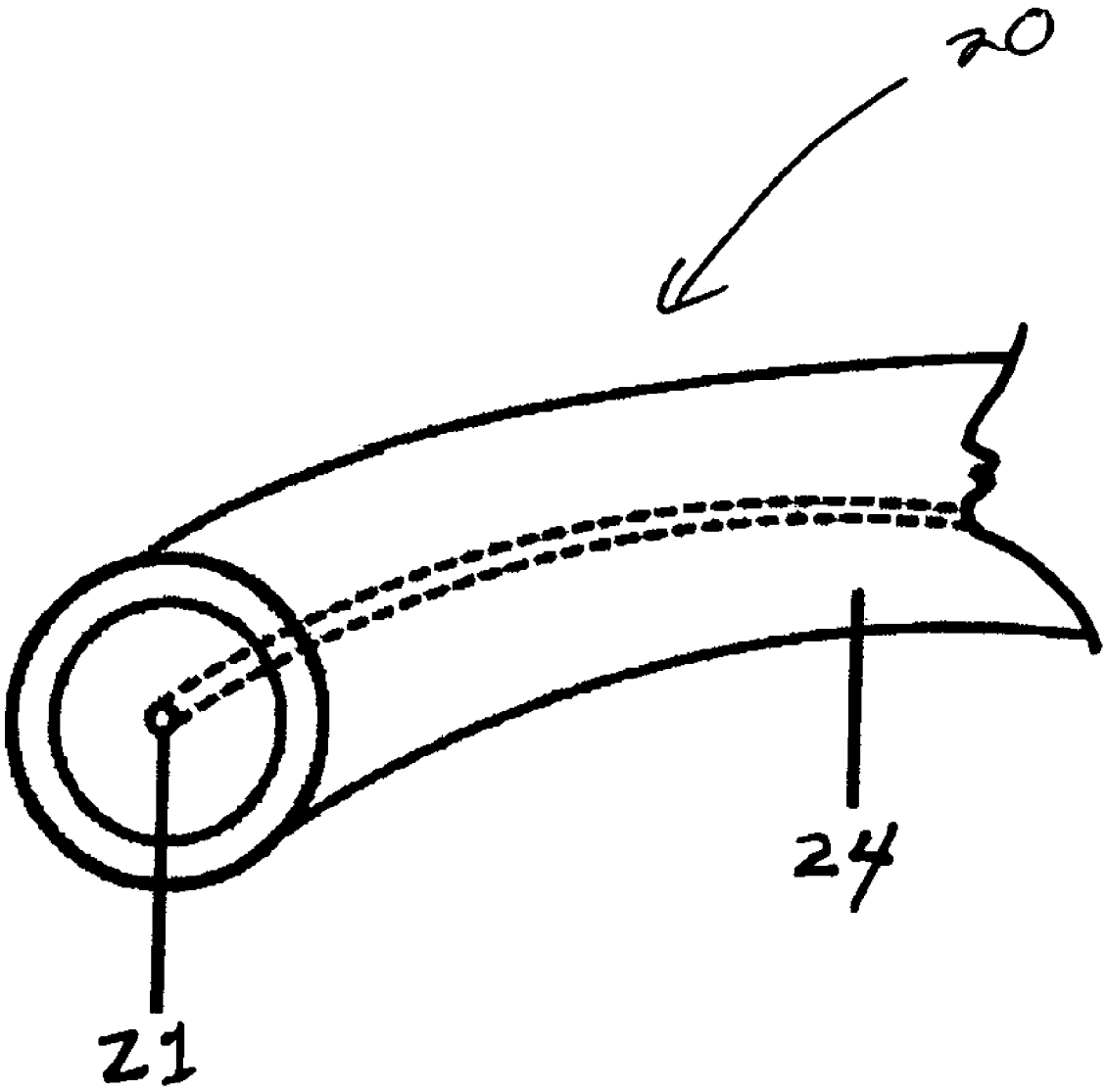
FIG. 5 is a cross sectional view of a ductile element according to the present disclosure.

Referring now to FIG. 5, in yet another aspect, ductile element 20 may have a ductile component 21. Ductile component 21 may be generally linear, or adopt any other suitable shape. A foam cover such as foam cover 24 sheathes ductile component 21. Foam cover 24 increases the comfort of the horse and helps to protect the horse from injury due to contact with ductile component 21.

Having now described the invention in accordance with the requirements of the patent statutes, those skilled in this art will understand how to make changes and modifications in the present invention to meet their specific requirements or conditions. Such changes and modifications may be made without departing from the scope and spirit of the invention as set forth in the following claims.

What is claimed is:

1. A saddle pad comprising:

a primary pad having an inner surface, and outer surface, an apex and a leading edge; and one or more malleable elements embedded in the primary pad near the leading edge forming a malleable area;

wherein the one or more malleable elements further comprise:

a generally linear ductile component; and a malleable sheath enveloping the ductile component.

2. The saddle pad of claim 1 further comprising:

at least two secondary pads embedded in the malleable area.

3. The saddle pad of claim 2 further comprising:

a web element embedded within the malleable area.

4. The saddle pad of claim 1 further comprising:

a web element dorsal reinforcement attached to the outer surface of the primary pad along the apex.

5. The saddle pad of claim 1 further comprising:

a web element dorsal reinforcement attached to the inner surface of the primary pad along the apex.

6. A saddle pad comprising:

a primary pad having an inner surface, and outer surface, an apex and a leading edge;

one or more malleable elements embedded in the primary pad near the leading edge forming a malleable area;

at least two secondary pads embedded in the malleable area;

a first web element dorsal reinforcement attached to the outer surface of the primary pad along the apex;

a second web element dorsal reinforcement attached to the inner surface of the primary pad along the apex; and a web element embedded within the malleable area.

* * * * *